US005239821A

United States Patent [19]

Guirguis

[11] Patent Number: 5,239,821

[45] Date of Patent: Aug. 31, 1993

[54] UNDERWATER TURBOJET ENGINE

[75] Inventor: Raafat M. Guirguis, Fairfax, Va.

[73] Assignee: The United States of America as represented by the Secretary of the Navy, Washington, D.C.

[21] Appl. No.: 728,916

[22] Filed: Jul. 11, 1991

[51] Int. Cl.[5] ..... F02K 11/00

[52] U.S. Cl. ..... 60/221; 60/39.35; 60/39.464

[58] Field of Search ..... 60/39.05, 39.35, 39.961, 60/39.464, 39.53, 39.57, 221, 222, 39.36

[56] References Cited

U.S. PATENT DOCUMENTS 2,704,645 3/1955 Colvin ..... 60/39.36
3,328,957 7/1967 Rose ..... 60/39.05
4,089,631 5/1978 Giles ..... 60/39.464
4,646,515 3/1987 Guirguis ..... 60/39.35
4,897,995 2/1990 Guirguis ..... 60/39.35
5,010,728 4/1991 Joy ..... 60/39.464

*Primary Examiner*—Louis J. Casaregola
*Attorney, Agent, or Firm*—John D. Lewis; Jacob Shuster

[57] ABSTRACT

A solid particle fuel is introduced into a reaction zone of a continuous flow conduit between pump and turbine flow sections thereof within a turbojet engine. The fuel reacts on contact with the motive liquid within the reaction zone and produces bubbles of a non-condensible gas as a reaction product during rotation of the engine rotor to which pump and turbine blading is fixed within the pump and turbine flow sections of the conduit.

11 Claims, 1 Drawing Sheet

UNDERWATER TURBOJET ENGINE

BACKGROUND OF THE INVENTION

This invention relates generally to turbojet engines and more particularly to such engines employing liquid as a motive flow medium. Engines of this type are covered in my prior U.S. Pat. Nos. 4,646,515 and 4,897,995, the disclosures of which are incorporated herein by reference.

According to my earlier U.S. Pat. No. 4,646,515, a motive liquid such as water flows through an annular passage within an engine, said passage forming a rotating conduit between rotor blading and stationary walls of the engine housing. Flow sections of the conduit form a centrifugal pump at the inlet end and a centrifugal turbine at the exit end of the conduit. Pump and turbine portions of the blading are fixedly mounted on a common rotor shaft which also mounts axial blades forming the combustion section within the conduit axially spacing the pump and turbine flow sections. Bubbles of a combustible gas are introduced into the flow of liquid through the conduit at the inlet end for sequential compression, ignition and expansion as the gas bubbles are carried in the motive liquid through the pump, combustion and turbine sections of the flow conduit. Flow exiting the turbine section of the conduit is recycled to the pump section while exhaust gases in the bubbles are drawn and expelled through a passage in the rotor shaft.

According to my later U.S. Pat. No. 4,897,995, the burned bubbles of gas are exhausted with the motive liquid from the turbine flow section at the exit end of the conduit.

It is an important object of the present invention to provide an engine of the foregoing type which is more suitable for underwater applications, where light weight, small size, high power output and high speeds are essential.

SUMMARY OF THE INVENTION

In accordance with the present invention, the motive working liquid conducted through the engine also acts as an oxidizer reacting with the fuel on contact, as does air in conventional turbojet engines. Further in accordance with the present invention the fuel is either in liquid or solid form. The motive liquid according to different embodiments of the invention is pure water, sea water having impurities or any other liquid capable of reacting with the fuel on contact. For example, a fuel such as lithium hydride (LiH) in the form of solid particles reacts on contact with the water to produce lithium hydroxide that dissolves in the water and hydrogen gas bubbles in the water. Rotation of the engine rotor is sustained by the difference in torque between the turbine and pump. Expansion of the gas bubbles in the turbine section of the engine conduit pushes the liquid at higher velocity through the angularly offset blades at the turbine exit end. The higher torque is expended in inducing flow of the motive liquid through the inlet of the engine conduit and displacing it through the pump section. Flow of the motive liquid from the pump to the turbine section is sustained by generation of a pressure differential to overcome the frictional resistance to flow exerted by the conduit walls.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF THE PREFERRED EMBODIMENTS

Figure 1:
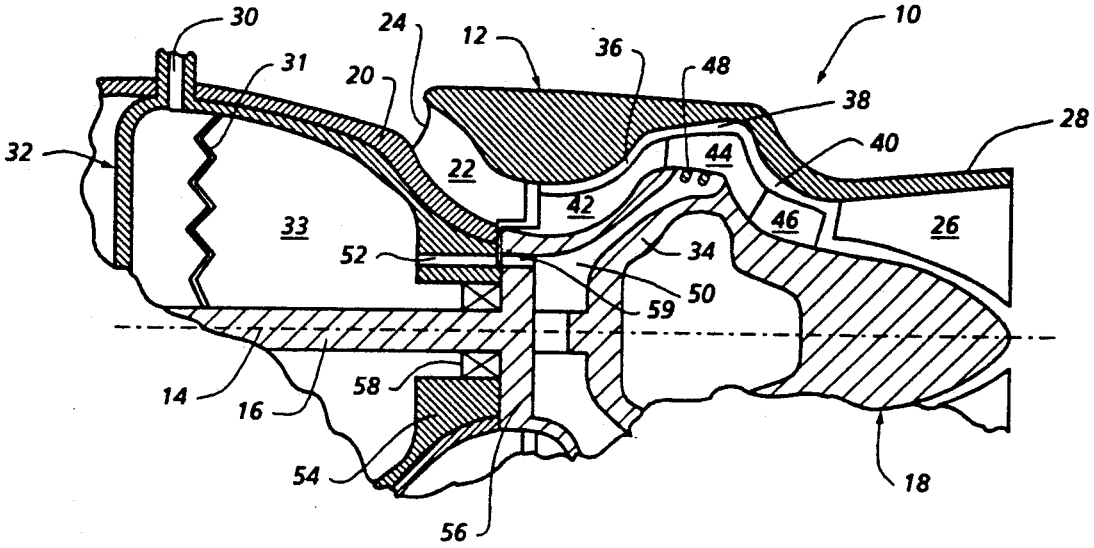
FIG. 1 is a partial side section view of a turbojet engine constructed in accordance with one embodiment of the invention.

Referring now to the drawing in detail, FIG. 1 illustrates a turbojet engine generally referred to by reference numeral 10, in accordance with one embodiment of the invention, to be propelled through a fluent medium such as sea water as part of some underwater turbojet propulsion system. The engine includes an outer housing 12 having a longitudinal axis 14 about which a shaft 16 is rotatable. An annular flow passage conduit is formed internally of the housing about the shaft 16 to which a rotor, generally referred to by reference numeral 18, is fixed. The fluent medium or sea water is conveyed through the flow passage conduit and acts as the motive liquid of the engine.

The housing 12 includes a forward portion 20 to which inlet blades 22 are fixed in radially outward relation to the shaft 16 for smoothly guided entry of the sea water into the engine as the motive liquid. The blades 22 extend axially from water inlet end 24 to a section 36 of the continuous flow passage of the annular conduit as shown in FIG. 1. Exit blades 26 are fixed to the rear end portion 28 of the housing for guiding the motive liquid to smoothly exit a divergent passage of the flow conduit through which both liquid and gas products are exhausted. In accordance with one embodiment of the invention as illustrated in FIG. 1, a reservoir 32 is fixedly mounted within the forward portion 20 of the housing to store a supply of fuel 33.

The rotor 18 supports thereon circumferentially arranged blades, each having axially extending portions 42, 44 and 46 respectively disposed within passage sections 36, 38 and 40 of the annular flow conduit formed between the stationary annular wall of engine housing 12 and the external surface of the rotor portion 34 on which the blades are fixedly mounted. The flow passage section 36 of the conduit together with radial blade portions 42 therein form a centrifugal pump to pressurize the motive liquid. A reaction zone is formed within the conduit section 38 through which blade portions 44 rotate. The flow passage section 40 of the conduit together with radial blade portions 46 therein form a centrifugal turbine to sequentially depressurize the motive liquid in axially spaced relation to the reaction zone section 38 and pump section 36 of the conduit along axis 14.

In accordance with the embodiment of the invention shown in FIG. 1, fuel is injected into the reaction zone in section 38 for initial contact therein with the motive liquid being propelled through the flow passage conduit. Such injection of the fuel is effected from fuel outlets 48 circumferentially spaced about the axis 14 of the rotor at the end of fuel passage 50 formed in the blade supporting portion 34 of the rotor. The fuel 33 is supplied to the passage 50 through bores 52 formed within the outlet end portion 54 of the fuel reservoir 32 and bores 59 radially aligned with bores 52 in the forward end 56 of the rotor portion 34 from which the rotor shaft 16 extends. The outlet end portion 54 of the fuel reservoir is provided with a bearing 58 journaling shaft 16 for rotation of the rotor 18 therewith about axis 14.

In view of the high pressure of the motive liquid within the reaction zone of section 38 and its increase with underwater depth, the fuel supplied thereto through passage 50 in the rotor portion 34 must be under a sufficiently high pressure. The radial spacing of fuel passage 50 from rotor axis 14 is accordingly designed to effect centrifugal generation of forces therein increasing the pressure of the fuel from the reservoir to overcome the pressure centrifugally generated within pump section 38. The pressure of the fuel within reservoir 32, on the other hand, must be equal to the external environmental pressure, i.e. the water pressure at inlet end 24 of the conduit. The fuel pressure in the reservoir is therefore equalized with the external pressure by providing a flexible bellows 31 to separate a fuel storing compartment within reservoir 32 from a body of water under the external pressure admitted through vent 30. In the event fuel pressure cannot be sufficiently increased by centrifugal action within passage line 50, then an auxiliary pump may be added to the fuel line.

Large quantities of the fuel 33 may be stored within the reservoir 32 as solid particles carried in a slurry formed by an inert liquid for conveyance of such fuel particles to conduit section 38 through passage 50. The composition and/or properties of the solid particles is such that it reacts on contact with cold water to generate a non-condensible gas as a reaction product within the water acting as the motive liquid of the engine. A suitable example of such solid particle fuel is lithium hydride which reacts on contact with cold water (both fresh or salt water) without any heating and at a rate that increases with the water pressure. Further, there are no appreciable adverse affects caused by impurities in the water on the oxidation type of reaction involved: $LiH \rightarrow H_2O \rightarrow LiOH + H_2$. Thus, the inflow of water to the reaction zone in conduit section 38 under pressure increased by centrifugal pump section 36 forms an ideal environment for reaction between the water and the salt-like particles of lithium hydride.

As noted from the foregoing reaction formula, the reaction products are lithium hydroxide (LiOH) and hydrogen gas ($H_2$). The lithium hydroxide dissolves in the water and is thereby carried away from the reaction zone in conduit section 38 to prevent it from poisoning the fuel. The hydrogen gas, on the other hand, forms the core of gas bubbles providing the highest possible gas volume for any given water temperature and pressure because of its low molecular weight so as to maintain optimum water propelling thrust as the engine is propelled to greater underwater depths where the seawater becomes colder and its pressure increases. Further, the hydrogen gas is noncondensible within the water and liquefies at an extremely low temperature of −256° C., thereby eliminating any danger of diminishing thrust with increasing underwater depth.

The heat of the reaction in conduit section 38 increases the hydrogen gas temperature and may vaporize the water surrounding the bubbles. However, the heat used in vaporizing the water is not lost because of the increase in volume accompanying vaporization of the water exerting a propelling force on the water traveling through the depressurizing turbine section 40 of the conduit. In view of the non-condensible nature of the hydrogen gas, the gas bubbles do not fully collapse when the water vapor subsequently condenses in the cold water Blade pitting caused by liquid jets formed in response to full collapse of vapor bubbles is thereby avoided.

The water acts as both oxidizer and working fluid for a continuous flow engine in accordance with the present invention. The hydrogen gas bubbles, generated as a result of the reaction in conduit section 38, travels with the water through the turbine blade portions 46 in conduit section 40. Expansion of the gas bubbles in section 40 increases the flow velocity or rate of displacement of the water through the passages formed between the turbine blade portions 46 including angularly offset section 60 thereof at the turbine exit to thereby exert torque on the rotor.

Figure 2:
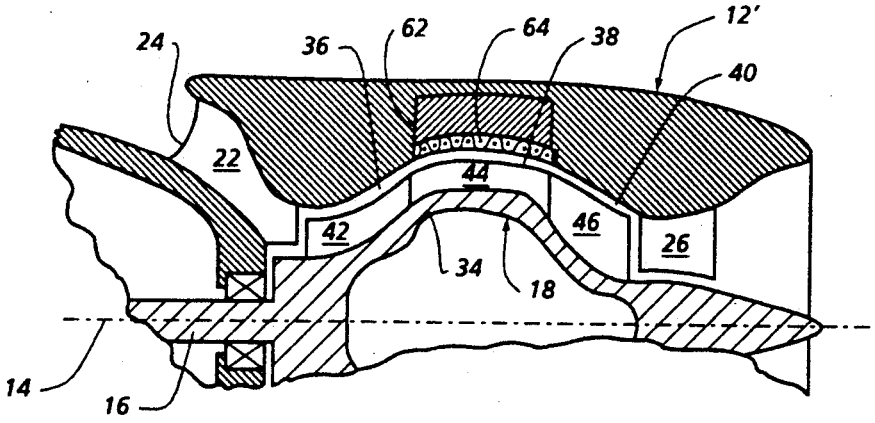
FIG. 2 is partial side section view of the turbojet engine showing certain modifications to the engine of FIG. 1 in accordance with another embodiment of the invention.

According to another embodiment shown in FIG. 2, a modified housing 12' encloses a fuel storage cavity 62 within which a body of solid fuel particles, such as lithium hydride, are stored adjacent to the reaction zone in section 38. A fuel outlet screen 64 restrictively regulates the contact between the fuel particles and the liquid into the reaction zone in response to the flow of the liquid in section 38 which is the same as described with respect to FIG. 1.

Numerous other modifications and variations of the present invention are possible in light of the foregoing teachings. It is therefore to be understood that within the scope of the appended claims the invention may be practiced otherwise than as specifically described.

What is claimed is:

1. In combination with an engine propelled through a fluent medium comprising a liquid under an external pressure, said engine including a housing, a rotor, means for rotatably mounting the rotor within the housing to form therewithin a continuous flow passage, inlet means mounted in the housing for guiding inflow of said fluent medium into the continuous flow passage, blade means mounted on the rotor within said continuous flow passage for sequential pressurization and depressurization of the fluent medium in response to rotation of the rotor, a source of non-gaseous fuel within the housing and means conducting said fuel from the source into the continuous flow passage for reaction therein by direct contact with the fluent medium to generate a reaction product substantially non-condensible within the fluent medium.

2. In combination with an engine adapted to be propelled through a fluent medium comprising a liquid under an external pressure, said engine including a housing, a rotor, means for rotatably mounting the rotor within the housing to form therewithin a continuous flow passage, inlet means mounted in the housing for guiding inflow of said fluent medium into the continuous flow passage, blade means mounted on the rotor within said continuous flow passage for sequential pressurization and depressurization of the fluent medium in response to rotation of the rotor, a source of non-gaseous fuel reactable with the fluent medium on contact and means introducing said fuel into the continuous flow passage for reaction by direct contact with the fluent medium to generate a non-condensible reaction product, said continuous flow passage including pump and expansion sections within which said pressurization and depressurization of the fluent medium relative to the external pressure thereof is respectively effected by the blade means and a reaction section axially spacing the pump and expansion sections, said fuel introducing means injecting the fuel into the reaction section of the flow passage for generation of bubbles of the non-condensible reaction product therein.

3. The improvement as defined in claim 2 wherein said source of the fuel comprises means for storing said fuel within the housing at a pressure equal to the external pressure of the fluent medium.

4. The improvement as defined in claim 2 wherein said source of the fuel comprises reservoir means for storing the fuel as solid particles carried in a slurry of an inert liquid conveyed by the fuel introducing means to the reaction section.

5. In combination with an engine adapted to be propelled through a fluent medium under an external pressure, said engine including a housing, a rotor, means for rotatably mounting the rotor within the housing to form therewithin a continuous flow passage, inlet means mounted in the housing for guiding inflow of aid fluent medium into the continuous flow passage, blade means mounted on the rotor within said continuous flow passage for sequential pressurization and depressurization of the fluent medium in response to rotation of the rotor, a source of non-gaseous fuel reactable with the fluent medium on contact and means introducing said fuel into the continuous flow passage for reaction by direct contact with the fluent medium to generate a non-condensible reaction product, said continuous flow passage including pump and expansion sections within which said pressurization and depressurization of the fluent medium relative to the external pressure thereof is respectively effected by the blade means and a reaction section axially spacing the pump and expansion sections, said fuel introducing means injecting the fuel into the reaction section of the flow passage for generation of bubbles of the non-condensible reaction product therein, said source of the fuel comprising reservoir means for storing the fuel as solid particles carried in a slurry of an inert liquid conveyed by the fuel introducing means to the reaction section, said solid particles of the fuel being lithium hydride and the non-condensible reaction product being hydrogen gas.

6. The combination of claim 5 wherein the fluent medium is water acting as a motive liquid.

7. In combination with an engine adapted to be propelled through a fluent medium under an external pressure, said engine including a housing, a rotor, means for rotatably mounting the rotor within the housing to form therewithin a continuous flow passage, inlet means mounted in the housing for guiding inflow of aid fluent medium into the continuous flow passage and blade means mounted on the rotor within said continuous flow passage for sequential pressurization and depressurization of the fluent medium in response to rotation of the rotor, the improvement residing in a source of non-gaseous fuel retractable with the fluent medium on contact and means introducing said fuel into the continuous flow passage for reaction by direct contact with the fluent medium to generate a reaction product substantially non-condensible within the fluent medium, said fuel being solid particles of lithium hydride and the non-condensible reaction product being hydrogen gas.

8. In combination with an engine adapted to be propelled through a fluent medium, including a housing, a rotor, means for rotatably mounting the rotor within the housing to form therewithin a flow passage, inlet means mounted by the housing for guiding inflow of said fluent medium into the flow passage and blade means mounted on the rotor within said flow passage for sequential pressurization and depressurization of the inflowing fluent medium in response to rotation of the rotor, the improvement residing in: a source of solid particles of lithium hydride and fuel supply means interconnecting said source with the flow passage for reaction of the solid particles with the fluent medium on contact.

9. The combination of claim 8 wherein said fluent medium is sea water oxidizing the solid particles by said reaction therewith to form bubbles of hydrogen gas as a reaction product.

10. In combination with an engine within which a motive liquid is conveyed through a flow passage, including a housing through which the flow passage extends, a rotor mounted for rotation about a longitudinal axis of the housing, blade means mounted on the rotor for sequential pressurization and depressurization of the motive liquid respectively within axially spaced sections of the flow passage, reaction means axially spacing said sections of the flow passage for increasing rate of displacement of the motive liquid through one of said sections of the flow passage, the improvement residing in a source of fuel reactable on contact with the motive liquid within the reaction means and means supplying said fuel from the source to the reaction means for generation of bubbles of a reaction product that is non-condensible within the motive liquid.

11. The improvement as defined in claim 10 wherein said fuel is lithium hydride and the reaction product is hydrogen.

* * * * *